US007770663B2

(12) United States Patent
Mathiszik

(10) Patent No.: US 7,770,663 B2
(45) **Date of Patent: *Aug. 10, 2010**

(54) APPARATUS FOR MAKING QUALITY CONTROL MEASUREMENTS WHILE DRILLING

(75) Inventor: Holger Mathiszik, Wathlingen (DE)

(73) Assignee: Baker Hughes Incorporated, Houston, TX (US)

( * ) Notice: Subject to any disclaimer, the term of this patent is extended or adjusted under 35 U.S.C. 154(b) by 114 days.

This patent is subject to a terminal disclaimer.

(21) Appl. No.: 11/945,966

(22) Filed: Nov. 27, 2007

(65) Prior Publication Data

US 2008/0086270 A1 Apr. 10, 2008

Related U.S. Application Data

(63) Continuation of application No. 10/802,623, filed on Mar. 17, 2004, now Pat. No. 7,299,884.

(51) Int. Cl.
*E21B 21/08* (2006.01)
*E21B 47/12* (2006.01)
*E21B 49/00* (2006.01)

(52) U.S. Cl. ..... 175/48; 73/152.03; 73/152.46; 73/152.15; 175/40; 702/9

(58) Field of Classification Search ..... 73/152.03, 73/152.46, 152.15; 175/48, 40; 702/9
See application file for complete search history.

(56) References Cited

U.S. PATENT DOCUMENTS

| | | | | |
|---|---|---|---|---|
| 5,705,927 | A | 1/1998 | Sezginer et al. | 324/303 |
| 6,237,404 | B1 | 5/2001 | Crary et al. | 73/152.03 |
| 6,247,542 | B1 | 6/2001 | Kruspe et al. | 175/40 |
| 6,268,726 | B1 | 7/2001 | Prammer et al. | 324/303 |
| 6,446,736 | B1 | 9/2002 | Kruspe et al. | 175/40 |
| 6,459,263 | B2 | 10/2002 | Hawkes et al. | 324/303 |
| 6,637,524 | B2 | 10/2003 | Kruspe et al. | 175/40 |
| 6,769,497 | B2 | 8/2004 | Dubinsky et al. | 175/27 |
| 6,823,265 | B2 | 11/2004 | Haldorsen | |
| 2004/0020691 | A1 | 2/2004 | Krueger | |
| 2004/0222019 | A1 | 11/2004 | Estes et al. | |

*Primary Examiner*—Jennifer H Gay
*Assistant Examiner*—Nicole A Coy
(74) *Attorney, Agent, or Firm*—Mossman Kumar & Tyler PC

(57) ABSTRACT

Measurements are made continuously with a seismic while drilling (SWD) system and the measured data are stored in a working memory of a downhole processor along with quality control (QC) measurements. The QC data are analyzed and based on the analysis, portions of the data in working memory are recorded in permanent memory for retrieval. Alternatively, QC measurements are made substantially continuously predictions are made when data quality for SWD measurements are likely to be good. Recording of SWD data are then started based on the prediction.

7 Claims, 5 Drawing Sheets

APPARATUS FOR MAKING QUALITY CONTROL MEASUREMENTS WHILE DRILLING

CROSS REFERENCES TO RELATED APPLICATIONS

This application is a continuation of U.S. patent application Ser. No. 10/802,623, filed Mar. 17, 2004 which is now U.S. Pat. No. 7,299,884.

BACKGROUND OF THE INVENTION

1. Field of the Invention

The present invention relates to an improved method of determining, while drilling in the earth with a drill bit, the positions of geologic formations in the earth. More particularly, it relates to a method for improving the quality of the acquired data.

2. Description of the Related Art

Conventional reflection seismology utilizes surface sources and receivers to detect reflections from subsurface impedance contrasts. The obtained image often suffers in spatial accuracy, resolution and coherence due to the long travel paths between source, reflector, and receiver. In particular, due to the two way passage of seismic signals through a highly absorptive near surface weathered layer with a low, laterally varying velocity, subsurface images are poor quality. To overcome this difficulty, a technique commonly known as vertical seismic profiling (VSP) was developed to image the subsurface in the vicinity of a borehole. With VSP, a surface seismic source is used and signals are received at a single downhole receiver or an array of downhole receivers. This is repeated for different depths of the receiver (or receiver array). In offset VSP, a plurality of spaced apart sources are sequentially activated, enabling imaging of a larger range of distances than is possible with a single source During drilling operations, the drillstring undergoes continuous vibrations. The sensors used for making measurements indicative of formation parameters are also subject to these vibrations. These vibrations result in the sensor measurements being corrupted by noise. For the purposes of this invention, we distinguish between two types of noise. The first type of noise is that due to the sensor motion itself. This type of noise is particularly severe for nuclear magnetic resonance (NMR) measurements where the region of examination of the NMR sensor is typically no more than a few millimeters in size. With NMR measurements, the nuclear spins in the region of interest are prepolarized by a static magnetic field. The nuclear spins are tipped by a pulsed radio frequency (RF) magnetic field, and spin echo signals may be measured by applying a sequence of refocusing pulses. With this arrangement, sensor movement of a few mm results in the signals originating from regions that were either not prepolarized or partially polarized, resulting in low signal levels.

Examples of this type of noise in NMR applications are found in U.S. Pat. No. 5,705,927 to Sezginer et al., U.S. Pat. No. 6,268,726 to Prammer et al., and is U.S. Pat. No. 6,459,263 to Hawkes et al. The Sezginer patent approaches the problem by making the pulse sequence short enough to be tolerant to vibrations of the sensor assembly on the drilling tool. Prammer et al discloses an apparatus and method of NMR acquisition in which motion sensors are used, data are continuously acquired, and after the fact, a decision is made on which data are to be kept. The Hawkes patent discloses the use of motion triggered pulsing, i.e., predicting ahead of time when conditions are likely to be good for acquisition, and acquiring the NMR data based on the predictions.

Prammer includes a summary of the types of drillstring (and tool motion) that occur. These include (a) Shutdown. This mode is selected anytime the tool detects the presence of metallic casing and/or is on the surface, or detects motion phenomena that make NMR measurements impossible.

(b) Wireline emulation. When no motion is detected, the tool attempts to emulate NMR measurements as typically done by wireline NMR tools.

(c) Normal drilling. During normal drilling conditions, moderate lateral motion is present, which allows for abbreviated NMR measurements.

(d) Whirling. During whirling, lateral motion is violent, but short time windows exist during which the lateral velocity drops to a point, where a porosity-only measurement is possible. The tool identifies these windows and synchronizes the NMR measurement appropriately.

(e) Stick-slip. In this drilling mode, windows exist in which short NMR measurements are possible, interspersed with periods of very high lateral/rotational motion. Again, the tool identifies these windows and synchronizes the NMR measurement appropriately.

It is to be noted that the "noise" problem addressed in Sezginer, Prammer and Hawkes are due only to the vibration of the sensor. Other causes of noise are not addressed.

However, many of the commonly used formation evaluation sensors are relatively insensitive to tool motion. These include resistivity sensors. Nuclear sensors such as neutron and gamma ray sensors are somewhat less sensitive, but could be affected to the extent that the dual sensors used may see different standoff and hence may result in improper compensation. Borehole acoustic logging tools are relatively insensitive as long as the tool motion is not so large as to severely affect the formation modes that are excited. Seismic while drilling (SWD) methods would be affected if accelerometers and/or geophones are used for detection of acoustic signals generated elsewhere whereas pressure sensors are relatively insensitive to tool motion.

A second type of noise that occurs in MWD is substantially independent of the motion of the sensor. Examples of these are in acoustic logging and SWD where the drillstring and drillbit vibrations are the source of noise. These could be in the form of body waves through the formation, body waves through the drillstring, and tube waves within the borehole. In SWD, other noises include tube waves generated by the seismic source and noise caused by flow of the drilling mud. U.S. Pat. No. 6,237,404 to Crary et al. recognizes the fact that there are many natural pauses during rotary drilling operations where a portion of the drill string remains stationary. Pauses include drill pipe connections, circulating time, and fishing operations. These pauses are used to obtain formation evaluation measurements that take a long time or measurements that benefit from a quiet environment, as opposed to the naturally noisy drilling environment. Various techniques that are sensitive to the mud flow, weight-on-bit, or motion of the drill string may be used alone or in combination to identify the drilling mode and control the data acquisition sequence. A drawback of the Crary patent is the rather conservative approach in which data acquisition is limited to the pauses in drilling, resulting in data acquisition at a coarse sampling interval corresponding to the length of drill pipe segments. There are situations in which it may be possible to acquire data of adequate quality even outside of the quite intervals defined by the method of Crary.

There is a need for a method of obtaining formation evaluation information in a MWD system that addresses the shortcomings of the aforementioned teachings. Such a method should address noises due to sensor motion as well as noises due to other causes. Such a method should preferably be capable of dealing with a variety of types of noises. The present invention satisfies this need.

SUMMARY OF THE INVENTION

The present invention is a method for making measurements during drilling of a borehole. Measurements are made continuously with a formation evaluation (FE) sensor on a bottom hole assembly (BHA) over a time period that includes drilling of the borehole. Concurrently, quality control (QC) measurements are made, the QC measurements including at least one measurement not related to motion of the BHA. Digitized samples of the FE measurements are stored in a working memory of downhole processor. Intermittently, the QC measurements are analyzed, and based on the analysis, selected samples of the FE measurements are stored in a permanent memory of the processor. The FE sensors may include at least one hydrophone responsive to a seismic signal from a surface source or from another borehole. The FE sensors may include at least one geophone on a non-rotating sleeve of said BHA. The QC measurements may include a weight on bit (WOB), a flow rate of a fluid in the borehole, a level of a tube wave in the borehole, a level of motion of a non-rotating sleeve, or a measurement made by a near bit accelerometer.

An alternate embodiment of the invention is a method for making measurements during drilling of a borehole in which quality control (QC) measurements are made using a sensor on a bottom hole assembly (BHA) during drilling. The QC measurements include at least one measurement not related to a motion of the BHA. The QC measurements are analyzed. A prediction is made of an initial time when measurements made by a formation evaluation (FE) sensor on the BHA are expected to be of acceptable quality. Measurements are made with the FE sensor over a time interval that starts earlier than predicted initial time. The FE sensor may be an acoustic sensor responsive to a signal from a source at a surface location or in another borehole. The acoustic sensor may be a hydrophone, geophone or accelerometer. The prediction may be made based on measurements made by an axial accelerometer on the BHA. The prediction may be made based on monitoring of mud flow in the borehole.

BRIEF DESCRIPTION OF THE DRAWINGS

The present invention is best understood with reference to the accompanying figures in which like numerals refer to like elements, and in which.

DETAILED DESCRIPTION OF THE INVENTION

The present invention is described with reference to acoustic sensors used in seismic while drilling methodology. However, this is not intended to be a limitation, and the method generally described herein can also be used with other types of sensor measurements.

Figure 1:
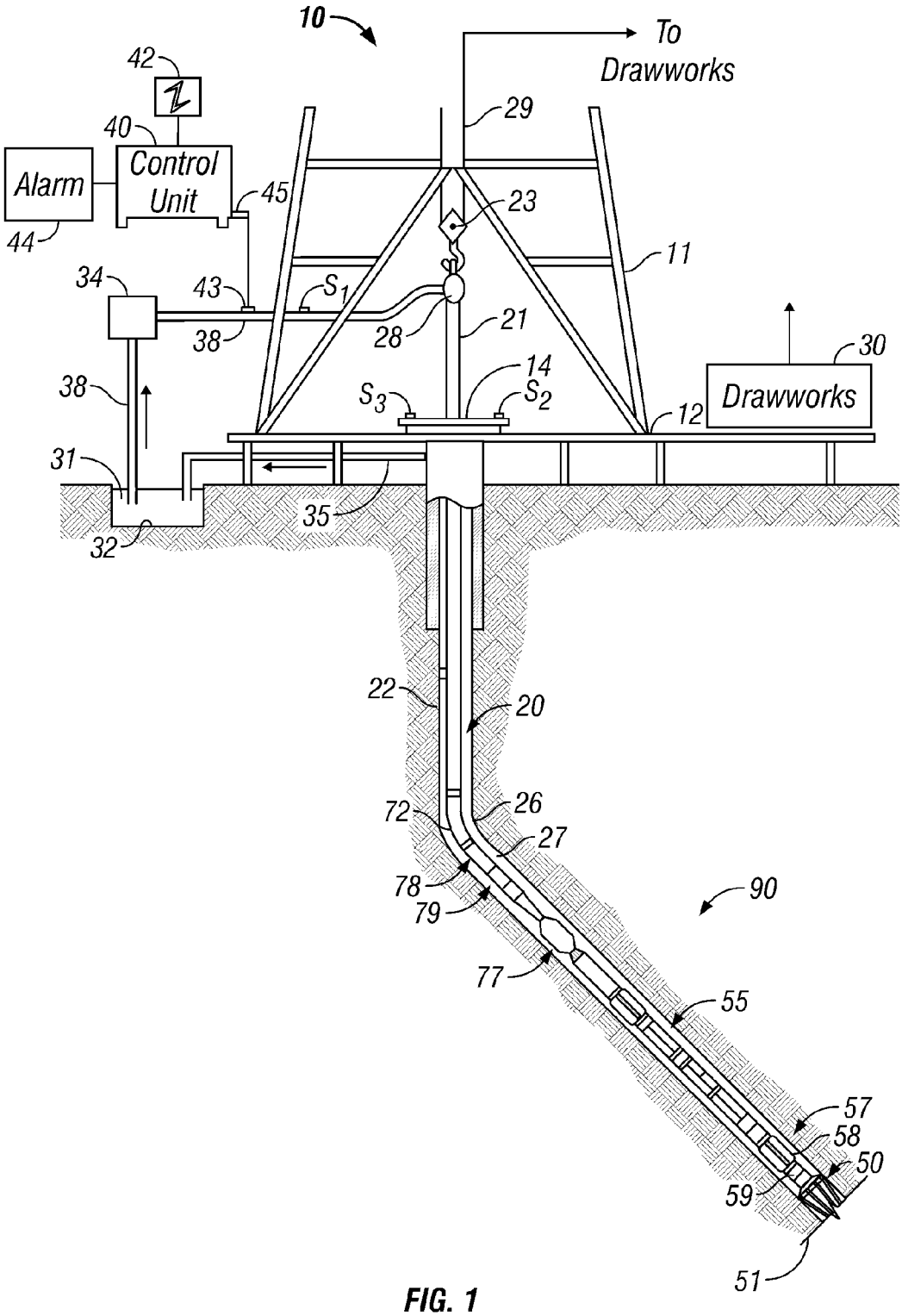
FIG. 1 (Prior Art)
FIG. 1 (Prior Art) shows a measurement-while-drilling device suitable for use with the present invention.

FIG. 1 shows a schematic diagram of a drilling system 10 with a drillstring 20 carrying a drilling assembly 90 (also referred to as the bottom hole assembly, or "BHA") conveyed in a "wellbore" or "borehole" 26 for drilling the borehole. The drilling system 10 includes a conventional derrick 11 erected on a floor 12 which supports a rotary table 14 that is rotated by a prime mover such as an electric motor (not shown) at a desired rotational speed. The drillstring 20 includes a tubing such as a drill pipe 22 or a coiled-tubing extending downward from the surface into the borehole 26. The drillstring 20 is pushed into the borehole 26 when a drill pipe 22 is used as the tubing. For coiled-tubing applications, a tubing injector, such as an injector (not shown), however, is used to move the tubing from a source thereof, such as a reel (not shown), to the borehole 26. The drill bit 50 attached to the end of the drillstring breaks up the geological formations when it is rotated to drill the borehole 26. If a drill pipe 22 is used, the drillstring 20 is coupled to a drawworks 30 via a kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drillstring 20 by a mud pump 34. The drilling fluid passes from the mud pump 34 into the drillstring 20 via a desurger (not shown), fluid line 28 and kelly joint 21. The drilling fluid 31 is discharged at the borehole bottom 51 through an opening in the drill bit 50. The drilling fluid 31 circulates uphole through the annular space 27 between the drillstring 20 and the borehole 26 and returns to the mud pit 32 via a return line 35. The drilling fluid acts to lubricate the drill bit 50 and to carry borehole cutting or chips away from the drill bit 50. A sensor $S_1$ placed in the line 38 can provide information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20.

In one embodiment of the invention, the drill bit 50 is rotated by only rotating the drill pipe 22. In another embodiment of the invention, a downhole motor 55 (mud motor) is disposed in the drilling assembly 90 to rotate the drill bit 50 and the drill pipe 22 is rotated usually to supplement the rotational power, if required, and to effect changes in the drilling direction.

In one embodiment of FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the invention, a drilling sensor module 59 is placed near the drill bit 50. The drilling sensor module contains sensors, circuitry and processing software and algorithms relating to the dynamic drilling parameters. Such parameters can include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 90. The drilling sensor module processes the sensor information and transmits it to the surface control unit 40 via the telemetry system 72.

The communication sub 72, a power unit 78 and an MWD tool 79 are all connected in tandem with the drillstring 20. Flex subs, for example, are used in connecting the MWD tool 79 in the drilling assembly 90. Such subs and tools form the bottom hole drilling assembly 90 between the drillstring 20 and the drill bit 50. The drilling assembly 90 makes various measurements including the pulsed nuclear magnetic resonance measurements while the borehole 26 is being drilled. The communication sub 72 obtains the signals and measurements and transfers the signals, using two-way telemetry, for example, to be processed on the surface. Alternatively, the signals can be processed using a downhole processor at a suitable location (not shown) in the drilling assembly 90.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 can include a computer or a microprocessor-based processing system, memory for storing programs or models and data, a recorder for recording data, and other peripherals. The control unit 40 can be adapted to activate alarms 44 when certain unsafe or undesirable operating conditions occur.

The apparatus for use with the present invention also includes a downhole processor that may be positioned at any suitable location within or near the bottom hole assembly. The use of the processor is described below.

Figure 2:
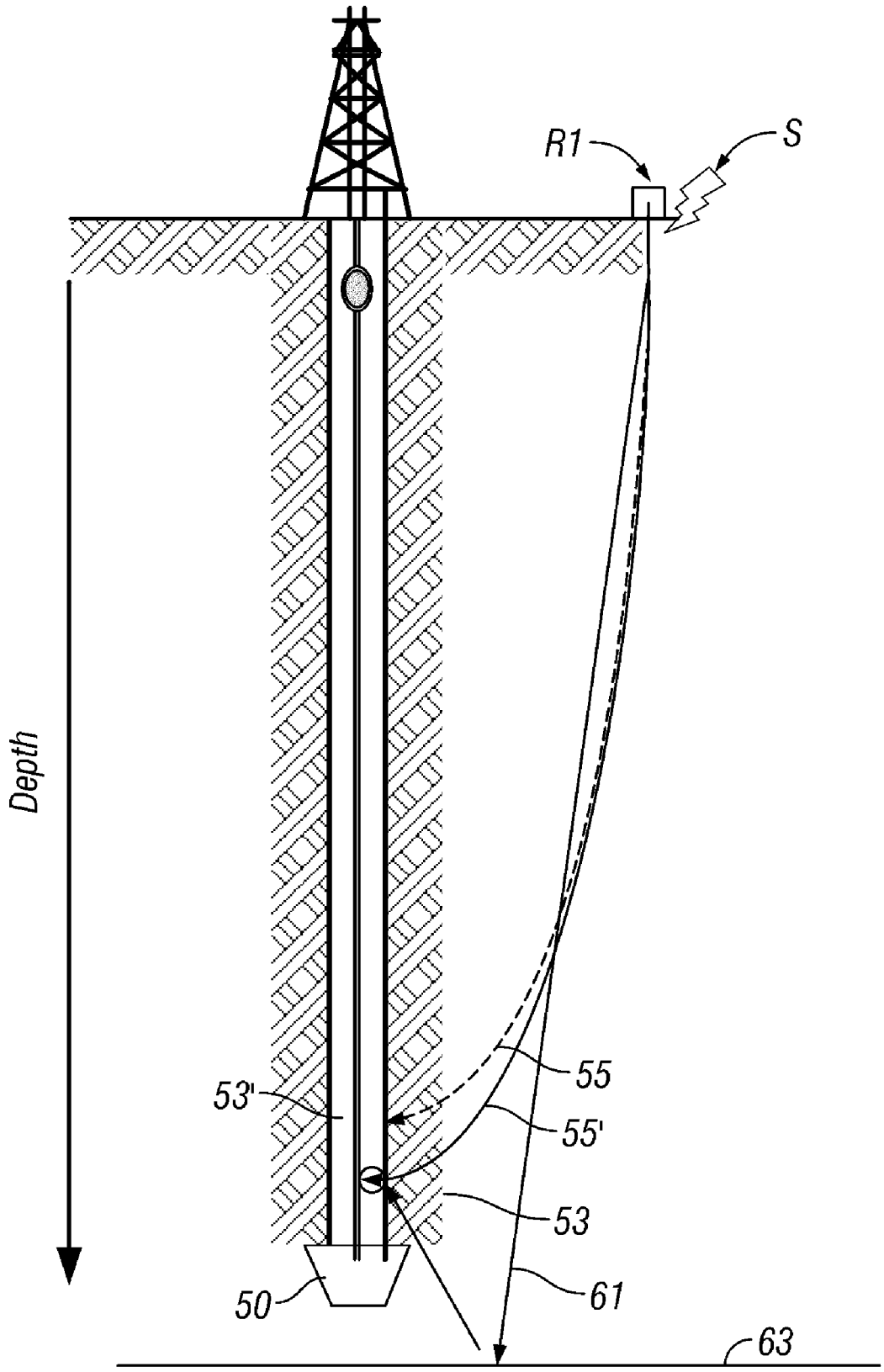
FIG. 2 illustrates the arrangement of source and sensors for the present invention.

Turning now to FIG. 2, an example is shown of source and receiver configurations for the method of the present invention. Shown is a drillbit 50 near the bottom of a borehole 26'. A surface seismic source is denoted by S and a reference receiver at the surface is denoted by R1. A downhole receiver is denoted by 53, while 55 shows an exemplary raypath for seismic waves originating at the source S and received by the receiver 53. The receiver 53 is usually in a fixed relation to the drillbit in the bottom hole assembly. Also shown in FIG. 2 is a raypath 55' from the source S to another position 53' near the bottom of the borehole. This other position 53' could correspond to a second receiver in one embodiment of the invention wherein a plurality of seismic receivers are used downhole. In an alternate embodiment of the invention, the position 53' corresponds to another position of the receiver 53 when the drillbit and the BHA are at a different depth.

Raypaths 55 and 55' are shown as curved. This ray-bending commonly happens due to the fact that the velocity of propagation of seismic waves in the earth generally increases with depth. Also shown in FIG. 2 is a reflected ray 61 corresponding to seismic waves that have been produced by the source, reflected by an interface such as 63, and received by the receiver at 53.

Figure 3:
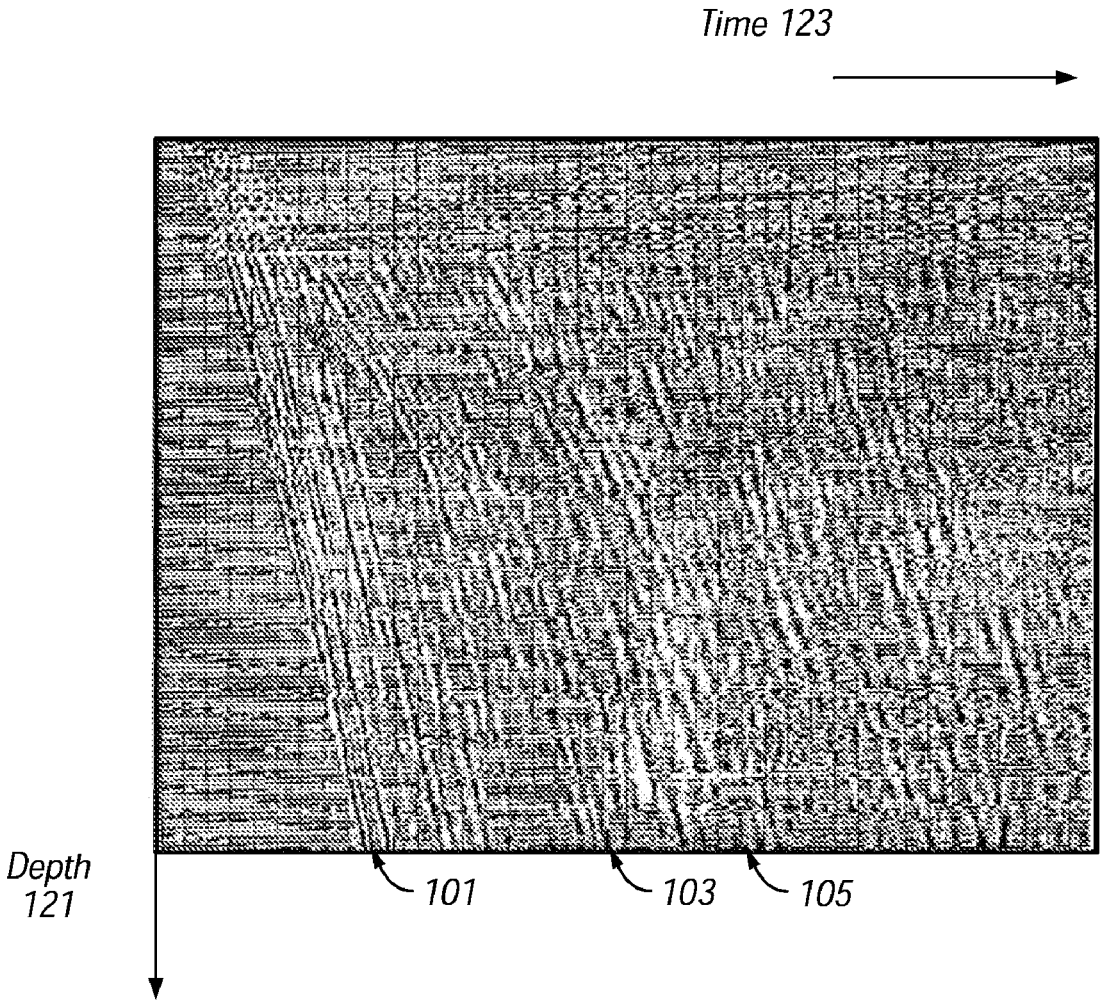
FIG. 3 (Prior Art)
FIG. 3 (Prior Art) shows an example of a vertical seismic profile.

An example of a VSP that would be recorded by such an arrangement is shown in FIG. 3. The vertical axis 121 corresponds to depth while the horizontal axis 123 corresponds to time. The exemplary data in FIG. 3 was obtained using a wireline for deployment of the receivers. Measurements were made at a large number of depths, providing the large number of seismic traces shown in FIG. 3.

Even to an untrained observer, several points are apparent in FIG. 3. One point of interest is the direct compressional wave (P-wave) arrival denoted by 101. This corresponds to energy that has generally propagated into the earth formation as a P-wave. Also apparent in FIG. 3 is a direct shear wave (S-wave) arrival denoted by 103. Since S-waves have a lower velocity of propagation than P-waves, their arrival times are later than the arrival times of P-waves.

Both the compressional and shear wave direct arrivals are of interest since they are indicative of the type of rock through which the waves have propagated. To one skilled in the art, other visual information is seen in FIG. 3. An example of this is denoted by 105 and corresponds to energy that is reflected from a deeper horizon, such as 63 in FIG. 2 and moves up the borehole. Consequently, the "moveout" of this is opposite too the moveout of the direct arrivals (P- or S-). Such reflections are an important part of the analysis of VSP data since they provide the ability to look ahead of the drillbit.

Figure 4:
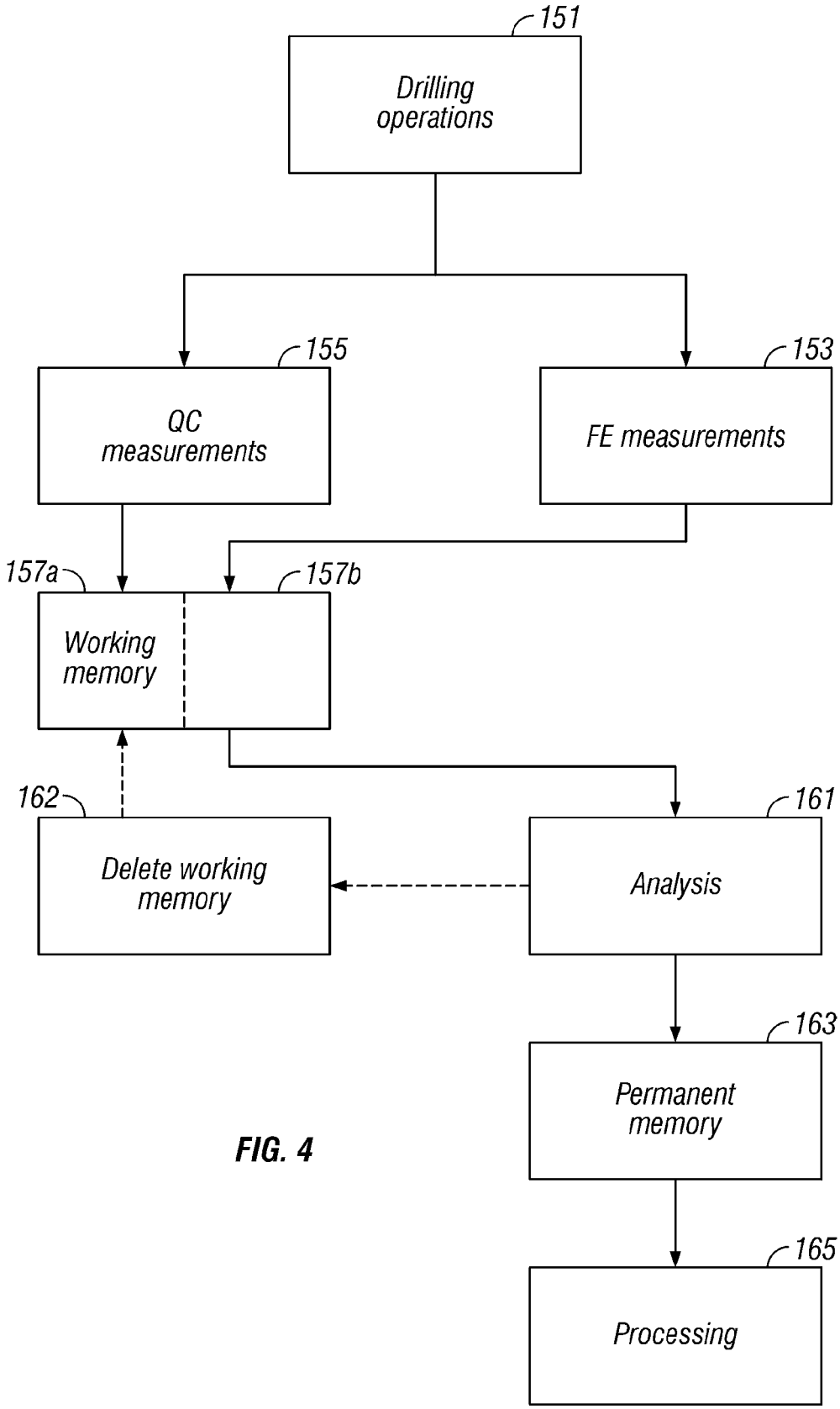
FIG. 4 shows a flow chart of processing carried out with one embodiment of the present invention.

Turning now to FIG. 4, a flow chart of an embodiment of the method of the present invention is shown. Drilling operations are started 151. The drilling operations include several modes discussed above in Prammer. During the drilling operations, certain quality control (QC) measurements 155 are made. The QC measurements include the axial and transverse accelerometer measurements taught by Prammer that are indicative of motion of the drillstring (and the sensor). In addition, measurements of weight on bit (WOB), rotational speed and bending of the drillstring may also be made. Mud-flow measurements may also used for QC.

Still referring to FIG. 4, during drilling operations, FE evaluation measurements are also made 153 continuously. Digitally sampled values of the QC measurements and the FE measurements are recorded into a working memory, depicted schematically in FIG. 4 by parts 157*a* and 157*b*. This partitioning is not a physical partition, and changes dynamically as drilling proceeds. Intermittently, the QC and FE measurements in the portion 157*b* of the working memory are analyzed 161. During this analysis phase, data continues to be recorded into other portions of the working memory, denoted by 157*a*. In the analysis 161, the QC measurements are used to selectively record a portion of the FE data into a permanent memory 163 while other portions of the FE data (and the associated QC data) are erased 162 from the working memory. The data in permanent memory 163 are then analyzed downhole or retrieved from the well when the drillstring is tripped out and analyzed at a surface location.

The selective recording of data in permanent memory and the erasing of part of the working memory are based on the analysis of the QC data and would depend upon the type of FE measurement being made. Examples of a FE measurement are SWD measurements, and specifically VSP measurements of the type discussed above. Three types of sensors may be used for VSP measurements. First, hydrophones may be used for receiving VSP signals downhole. Hydrophones are responsive to fluid pressure and are relatively insensitive to drillstring vibration. Being pressure sensors, hydrophone data do not directly measure shear motion in the formation, so that it is difficult or impossible to obtain information about formation shear velocities from hydrophone data. There may be some sensitivity of hydrophone data to mud flow, so that mud flow measurements may be used for the selective filtering of hydrophone data. In one embodiment of the invention, a flow sensing device may be used for monitoring the flow of drilling fluid. The important point to note is that as long as the flow rate is uniform, a downhole hydrophone would be primarily responsive to pressure changes due to the seismic source at the surface. Accordingly, when using a hydrophone for SWD, the QC may be based on an average of the variations in flow rate, e.g., in the root mean square (RMS) value of flow rate fluctuations. When the fluctuations are large, the measurements are not recorded in permanent memory. Some improvement in the signal to noise ratio (SNR) of the seismic measurements can be further obtained by stacking provided there is accurate synchronization a surface clock controlling a repetitive surface source and a downhole clock used for the recording. In this regard, the flow rate fluctuations would be random relative to the source signals.

Hydrophones are responsive to tube waves in the borehole. The tube waves may be generated by drillstring vibrations or may be generated by energy from the surface seismic source that enters the borehole near the surface and propagates down the borehole. Tube waves may also be generated by mud flow through constrictions or changes in diameter of the borehole. As is known in the art, tube waves are dispersive in nature whereas the body waves propagating directly from the surface seismic source to a downhole detector are substantially non dispersive. Accordingly, by using a plurality of spaced apart hydrophones and by suitable filtering, the direct signal from the surface may be identified. The level of the dispersive signal may be used as a QC indicator.

VSP measurements may also be made using geophones. These are velocity sensors, and must be well coupled to the borehole wall. This requirement can be met if geophones are mounted on a non-rotating sleeve that is clamped to the borehole wall during drilling operations. A non-rotating sleeve suitable for the purpose is disclosed in U.S. Pat. Nos. 6,247,542, 6,446,736 and 6,637,524 to Kruspe et al. having the same assignee as the present invention and the contents of which are incorporated herein by reference. When such a non-rotating sleeve is used, measurements are made at substantially the same spatial location during continued motion of the drillstring and/or drillbit. The QC analysis of the data would delete portions of the data where there is motion of the non-rotating sleeve and stack the rest of the signals for output to permanent memory.

VSP measurements may also be made using accelerometers. The acceleration of a drillstring during drilling operations, particularly in a plane perpendicular to the borehole axis, can be much greater than 10 m/sec$^2$. This is several orders of magnitude greater than the downhole signal from a surface seismic source. Since drillstring vibrations can have frequencies as high as 4 kHz while seismic signals are typically no more than 100 Hz, high cut filtering of the data may be done. Even in situations where the drillstring is centered in the borehole and has little lateral motion, noise generated by the drillbit can propagate along the drillstring and affect the SWD measurements. An acoustic isolator may be used to suppress these body waves. In addition, in one embodiment of the invention, a near bit accelerometer is also used. Signals from the near bit accelerometer are then used for QC and deciding which portions of the data are to be permanently recorded. Other QC indicators for deciding which of the accelerometer measurements are to be permanently stored include measurements of weight on bit (WOB) and rotational speed (RPM). These are direct indicators of possible motion of the drillstring. Another indicator is the mud flow since low mud flow is indicative of a cessation of drilling.

Figure 5:
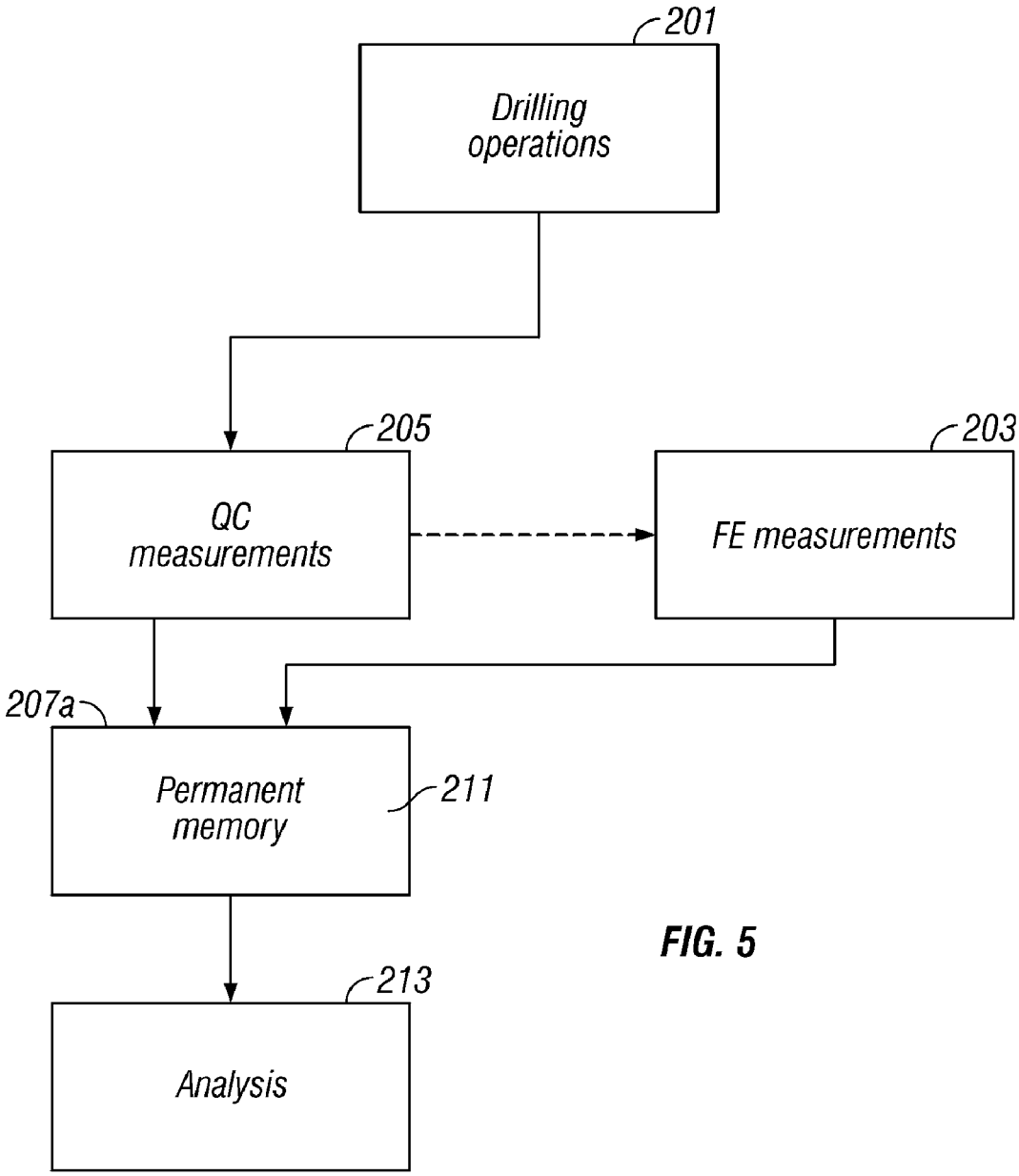
FIG. 5 shows a flow chart of processing carried out with one embodiment of the present invention.

Turning now to FIG. 5, another embodiment of the present invention is disclosed. During drilling operations 201, certain QC indicators are monitored 205. These could include WOB, RPM, mud flow. In addition, accelerometer measurements are made continuously. Based on the accelerometer measurements, a rate of penetration and/or drilling depth are determined. This may be done using the methods described in U.S. patent application Ser. No. 10/167,332 of Dubinsky et al., now U.S. Pat. No. 6,769,497, the contents of which are fully incorporated herein by reference.

As discussed in Dubinsky et al., an accelerometer on the downhole assembly is used to make measurements indicative of axial motion of the drilling assembly. In one embodiment of the invention of Dubinsky et al., these measurements are used to determine the axial velocity of motion. Maxima or minima of the velocity are identified and from these, the rate of penetration is determined assuming that the penetration occurs in discrete steps. Alternatively, maxima or minima of the axial displacement are determined and these are used to obtain a depth curve as a function of time. In an alternate embodiment of the invention of Dubinsky et al., the rate of penetration is determined from the average acceleration of the downhole assembly and its instantaneous frequency. The determined rate of penetration may then be used to control the operation of a logging while drilling tool. In the context of the present invention, this would be whenever the TD increases by a little bit less (approximately 1 ft. or 0.3 m) than the length of a segment of drill pipe (typically 30 ft). This is an indication that mud flow, WOB and RPM of the BHA will be decreasing in the near future, so that recording is started.

The QC measurements are then used to predict ahead of time when conditions are likely to be favorable for acquisition of FE data, and the FE data acquisition is started 203 based on the predictions. Specifically, a decrease in the mud flow is an indication that drilling may be temporarily suspended in the near future. A change in the drilling depth of 30 ft may be an indication that a new section of drill pipe will be added. The FE measurements are then started before the actual suspension of drilling or before the actual addition of a new drill pipe segment so as to ensure that data will be acquired during the optimal interval and also get additional data when the SNR is likely to be good. FE data acquired are then permanently recorded 211 in permanent memory 207*a* and subsequently analyzed 213 either downhole or after retrieval to a surface location.

The present invention has been described in the context of VSP data acquisition in which a seismic source is at or near a surface location. However, the invention could also be used when the seismic source is located in a preexisting borehole. With such an arrangement, crosswell measurements could be made during the process of drilling a borehole. Based on these crosswell measurements, the position of the borehole being drilled from a preexisting borehole can be determined and, based on the determined distance, the drilling direction of the borehole can be controlled.

While the foregoing disclosure is directed to the preferred embodiments of the invention, various modifications will be apparent to those skilled in the art. It is intended that all such variations within the scope and spirit of the appended claims be embraced by the foregoing disclosure

What is claimed is:

1. An apparatus configured to make measurements during drilling of a borehole, the apparatus comprising:

a Formation Evaluation (FE) sensor on a BottomHole Assembly (BHA) configured to make measurements continuously;

at least one sensor configured to concurrently make Quality Control (QC) measurements while said FE measurements are being made, said QC measurements including at least one measurement not related to motion of said BHA; and a processor on the BHA configured to:

(I) store samples of said FE measurements in a working memory;

(II) analyze the QC measurements; and (III) based on the analysis, store selected samples of said FE measurements in a permanent memory.

2. The apparatus of claim 1 wherein said FE sensor is selected from the group consisting of: (i) a hydrophone responsive to a seismic signal from a surface source, (ii) a geophone responsive to a seismic signal from a surface source, (iii) an accelerometer response to a signal from a surface source, and (iv) an acoustic sensor responsive to a signal from a surface source, and (v) an acoustic sensor responsive to a signal from a source in another borehole.

3. The apparatus of claim 1 wherein said at least one sensor is configured to be responsive to at least one of: (i) a Weight On Bit (WOB), (ii) a flow rate of a fluid in said borehole, (iii) a level of a tube wave in said borehole, (iv) a level of motion of a non-rotating sleeve on said BHA, and (v) a measurement made by a near bit accelerometer.

4. The apparatus of claim 1 wherein said QC measurements further comprise a measurement of motion of said BHA.

5. An apparatus configured to make measurements during drilling of a borehole, the apparatus comprising:

a sensor on a BottomHole Assembly (BHA) configured to make Quality Control (QC) measurements during drilling of said borehole, said QC measurements including at least one measurement not related to a motion of said BHA; and a processor configured to:

(I) analyze said QC measurements;

(II) use the results of the analysis for predicting an initial time when measurements made by a formation evaluation (FE) sensor on said BHA are expected to be of acceptable quality; and (III) record measurements with said FE sensor over a time interval that starts earlier than said initial time.

6. The apparatus of claim 5 wherein the processor is configured to do said predicting based at least in part on measurements made by an axial accelerometer on the BHA.

7. The apparatus of claim 5 wherein the processor is configured to do said predicting is based at least in part on monitoring of a mud flow in said borehole.

* * * * *